US006048231A

United States Patent [19]

Yamanashi et al.

[11] Patent Number: 6,048,231

[45] Date of Patent: Apr. 11, 2000

[54] BULB SOCKET PLUG AND METHOD OF PRODUCING SAME

[75] Inventors: Makoto Yamanashi; Seiji Kozono, both of Shizuoka, Japan

[73] Assignee: Yazaki Corporation, Tokyo, Japan

[21] Appl. No.: 09/130,460

[22] Filed: Aug. 7, 1998

[30] Foreign Application Priority Data

Aug. 7, 1997 [JP] Japan ..... 9-213425

[51] Int. Cl.[7] ..... H01R 24/00

[52] U.S. Cl. ..... 439/699.2

[58] Field of Search ..... 439/699.2, 682–685

[56] References Cited

U.S. PATENT DOCUMENTS

| | | | |
|---|---|---|---|
| 4,624,524 | 11/1986 | Durand | 339/176 L |
| 4,720,272 | 1/1988 | Duran | 439/699.2 |
| 5,080,615 | 1/1992 | Kondo | 439/699.2 |

FOREIGN PATENT DOCUMENTS

| | | | |
|---|---|---|---|
| 2-22951 | 6/1990 | Japan | H01R 33/09 |
| 3-29898 | 6/1991 | Japan | H01R 33/09 |

*Primary Examiner*—Michael L. Gellner
*Assistant Examiner*—Antoine Ngandjui
*Attorney, Agent, or Firm*—Sughrue, Mion, Zinn Macpeak & Seas, PLLC

[57] ABSTRACT

A connection terminal of a bulb socket plug has at one end thereof a bulb contact portion to which a bulb can be detachably connected, and also has at the other end thereof a connector contact portion to which a connector can be detachably connected. The bulb contact portion includes two side walls, and a central wall interconnecting the two side walls, and a contact portion for connection to a wedge portion of the bulb extends from at least one of the two opposed side walls. A stopper wall is bent relative to the side wall, and extends from a suitable portion of the side wall, and closes part of a space formed at a back side of the contact portion at a bulb insertion opening side. Tilt prevention inserts for preventing the tilting of the side walls are inserted respectively into spaces formed respectively at inner sides of the two side walls.

6 Claims, 7 Drawing Sheets

BULB SOCKET PLUG AND METHOD OF PRODUCING SAME

BACKGROUND OF THE INVENTION

1. Field of the Invention

This invention relates to a bulb socket plug for a wedge base bulb in a lighting device for a vehicle, and particularly relates to an improved construction of connection terminals insert molded in a bulb socket plug body.

The present application is based on Japanese Patent Application No. Hei. 9-213425, which is incorporated herein by reference.

2. Description of the Related Art

A bulb socket for a wedge base bulb and connection terminals, shown in FIG. 9, are disclosed in Japanese Utility Model Publication No. 3-29898. A socket body 50 includes a bulb insertion portion 51 for receiving the wedge base bulb, and a plug 52 to which a connector is adapted to be connected, the bulb insertion portion 51 and the plug 52 being formed integrally with each other. Two connection terminals 60 are integrally incorporated in the socket body 50 by insert molding, and bulb contact portions 61 of the connection terminals 60 are exposed within the bulb insertion portion 51, and connector contact portions 62 of the connection terminals 60 are exposed within the plug 52.

The connection terminal 60 is formed using a single metal sheet, and includes the bulb contact portion 61 for electrical connection to the bulb, and the connector contact portion 62 for electrical connection to the connector, the bulb contact portion 61 and the connector contact portion 62 being formed integrally with each other. The bulb contact portion 61 includes contact portions 63 which resiliently hold a wedge portion of the bulb, and are electrically connected to lead wires of the bulb, an upstanding wall 64 of a generally channel-shape generally surrounding the contact portions 63, interconnecting portions 63 each interconnecting the associated contact portion 63 and the upstanding wall 64, and abutment piece portions 66 abutted against an inner surface of the upstanding wall 64. FIG. 10 is a cross-sectional view taken along the line X—X of FIG. 9, and FIG. 11 is a partly-broken, side-elevational view of the connection terminal 60.

With the above construction, the connection terminals 60 are insert molded in the socket body 50, with an open portion of the upstanding wall 64 of each terminal closed by an insert of a mold, and therefore a resin material will not flow into a space between the contact portions 63, and the connection terminals 60 can be formed integrally in the socket body 50.

A lower portion 67 of each contact portion 63 of the bulb contact portion 61 of the connection terminal 60 is surrounded by the upstanding wall 64, and is supported by the interconnecting portion 65, connected to the upstanding portion 64, and the abutment piece portion 66 abutted against the inner surface of the upstanding wall, and therefore the contact portions 63 are positively prevented from being deformed or unduly bent away from each other when exchanging the bulb, and therefore the resiliency of the contact portions 63 can be stably maintained for a prolonged period of time.

However, with respect to the connection terminals 60 of the above construction, when the bulb is to be inserted into the space between each pair of contact portions 63 so as to attach the bulb to the bulb socket, the bulb is liable to be erroneously inserted or gougingly inserted into a space disposed at the rear sides of the contact portions 63 as indicated by arrow T in FIG. 11. Therefore, in order to prevent the erroneous insertion and the gouging insertion, there has been proposed a connection terminal 70 of a construction shown in FIG. 12.

The construction of the connection terminal 70, shown in FIG. 12, will be described. Those portions identical to those of the above construction will be designated by identical reference numerals, respectively, and explanation thereof will be omitted. Bent piece portions 69 and 69 are formed respectively at upper ends of opposed bent walls 68 and 68 of a channel-shaped upstanding wall 64 of a bulb contact portion 61, and extend to respectively cover spaces disposed respectively at rear sides of contact portions 63 and 63.

Thus, the bent piece portions 69 and 69 are provided at a bulb insertion opening to respectively cover the spaces disposed respectively at the rear sides of the contact portions 63 and 63, and with this construction, the erroneous insertion and gouging insertion of the bulb into the spaces, disposed respectively at the rear sides of the contact portions 63, are positively prevented.

In the connection terminal 70 of the above construction, the erroneous insertion and gouging insertion of the bulb can be prevented, but when molding a socket body 50, with the connection terminals 70 inserted in the mold, the two bent walls 68 and 68 of the connection terminal 70 are bent and deformed inwardly by the injection pressure of an injected resin.

FIG. 13 is a plan view of the connection terminal of FIG. 12, and the problem that the connection terminal 70 is deformed will be described more specifically. During the molding of the socket body 50, the two bent walls 68 and 68 of the upstanding wall 64 of the connection terminal 70 are subjected respectively to operating forces which act respectively in directions of arrows P because of the injection pressure of the injected resin. Therefore, these bent walls are bent and deformed inwardly as indicated by dots-and-dash lines, which has resulted in problems that the bulb can not be inserted or incompletely contacts the connection terminal, and that the resin flows into the space between the contact portions 63, thus causing the defective molding.

SUMMARY OF THE INVENTION

It is an object of the present invention to provide a bulb socket plug in which a bulb is prevented from being erroneously inserted or gougingly inserted into the bulb socket plug, and side walls of each connection terminal to be inserted in a socket body will not be deformed upon application of a pressure of an injected resin during a molding operation, and another object is to provide a method of producing this bulb socket plug.

In order to achieve the above object, according to the first aspect of the present invention, there is provided a bulb socket plug which comprises: a body; a connection terminal being insert molded in the body, the connection terminal including: a bulb contact portion to which a bulb is detachably connected formed at one end of the connection terminal, the bulb contact portion having first and second side walls opposed to each other and a contact portion formed between the first and second side walls, and a connector contact portion to which a connector is detachably connected formed at the other end of the connection terminal; and a stopper wall extending from the first side wall and being bent, the stopper wall which partially closes a first insertion space formed between the contact portion and the first side wall on an bulb insertion opening side of the bulb contact portion. In the bulb socket plug, a second insertion space is formed between the contact portion and the second side wall. Therefore, the first insertion space and the second insertion space respectively receive inserts which respectively prevent the first and second side walls from being deformed when the connection terminal is insert molded in the body. Accordingly, the erroneous insertion and gouging insertion of the bulb can be prevented, and the deformation of the connection terminal by the pressure of the injected resin during the molding is positively prevented by the tilt prevention inserts.

According to the second aspect of the present invention, in the bulb socket plug, the stopper wall may extend from one of an upper edge and a side edge of the first side wall. Accordingly, in such bulb socket plug, part of the space disposed at the rear side of the contact portion is closed, and therefore the erroneous insertion and gouging insertion of the bulb can be positively prevented. Since the insertion spaces for respectively receiving the tilt prevention inserts for preventing the tilting of the side walls are provided, the deformation of the connection terminal during the molding can be positively prevented.

Further, in order to achieve the above object, according to the third aspect of the present invention, there is provided a method of producing a bulb socket plug, which comprises: a step of preparing a connection terminal which comprises a bulb contact portion to which a bulb can be detachably connected formed at one end of the connection terminal, the bulb contact portion having first and second side walls opposed to each other and a contact portion formed between the first and second side walls, a connector contact portion to which a connector can be detachably connected formed at the other end of the connection terminal, and a stopper wall extending from the first side wall and being bent, the stopper wall which partially closes a first insertion space formed between the contact portion and the first side wall on an bulb insertion opening side of the bulb contact portion; and a step of molding the connection terminal, the step of molding which comprises a step of inserting first and second inserts respectively into the first insertion space and a second insertion space formed between the contact portion and the second side wall.

Furthermore, in order to achieve the above object, according to the fourth aspect of the present invention, there is provided a method of producing a bulb socket plug comprising a connection terminal being insert molded therein, the connection terminal including a bulb contact portion to which a bulb is detachably connected formed at one end of the connection terminal, and a connector contact portion to which a connector is detachably connected formed at the other end of the connection terminal, the method comprising: a step of providing an electrically conductive sheet including a first portion corresponding to the bulb contact portion and a second portion corresponding to the connector contact portion; a step of blanking the electrically conductive sheet to form at least one planar terminal member; a step of bending said at least one planar terminal member, the step of bending which comprises a step of forming first and second side walls opposed to each other through a central wall, a contact portion extended from at least one of the first and second side walls and bent in between the first and second side walls, and a stopper wall partially closing a first insertion space formed between the contact portion and the first side wall when the bulb contact portion is formed; and a step of molding the connection terminal, the step of molding which comprises a step of inserting first and second inserts respectively into the first insertion space and a second insertion space formed between the contact portion and the second side wall.

According to each of the methods of producing the bulb socket plug of the above construction, the erroneous insertion and gouging insertion of the bulb are prevented, and at the time of the molding, the tilt prevention inserts for preventing the tilting of the side walls are inserted respectively into the inserting spaces formed respectively at the inner sides of the two side walls, and in this condition the molding is effected. Accordingly, the deformation of the side walls by the pressure of the injected resin during the molding can be positively prevented.

DETAILED DESCRIPTION OF THE PREFERRED EMBODIMENTS

Figure 1:
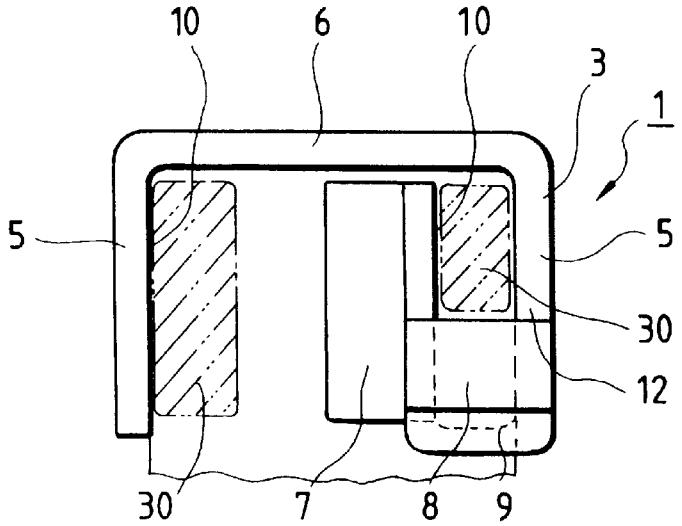
FIG. 1 is a plan view showing an important portion of a connection terminal to be insert molded in a bulb socket body of the present invention.

A construction of one preferred embodiment of a bulb socket plug of the present invention, as well as a method of producing the same, will now be described in detail with reference to FIGS. 1 to 5. FIG. 1 is a plan view of a connection terminal to be insert molded in a bulb insertion portion of the socket of the present invention, FIG. 2 is a side-elevational view showing an important portion of the connection terminal of FIG. 1, FIG. 3 is a plan view of a socket body having the connection terminals of the present invention insert molded therein, FIG. 4 is a cross-sectional view taken along the line IV—IV of FIG. 3, and FIG. 5 is a developed view of the connection terminal of the present invention.

As shown in FIGS. 1 to 4, the bulb socket plug 21 includes the bulb insertion portion 22 for receiving a bulb, and a plug 23 to which a connector is adapted to be connected, the bulb insertion portion 22 and the plug 23 being formed integrally with each other by molding. Each of the connection terminals 1 to be inserted in the bulb socket body 21 includes a bulb contact portion 3 formed at one end of a proximal end portion 2 thereof, and a connector contact portion 4 formed at the other end of the proximal end portion 2. The bulb contact portion 3 includes two side walls 5 and 5, which are bent relative to the proximal end portion, and extend therefrom, a central wall 6 interconnecting the two side walls, a contact portion 7 which is bent relative to one side wall 5 through an extension portion 9 extending from a side edge of the one side wall 5 at a lower end thereof, and a stopper wall 8 which is bent relative to the one side wall 5, and extends from an upper edge 12 of the one side wall 5 in a direction perpendicular to a direction Y of insertion of the bulb.

Figure 2:
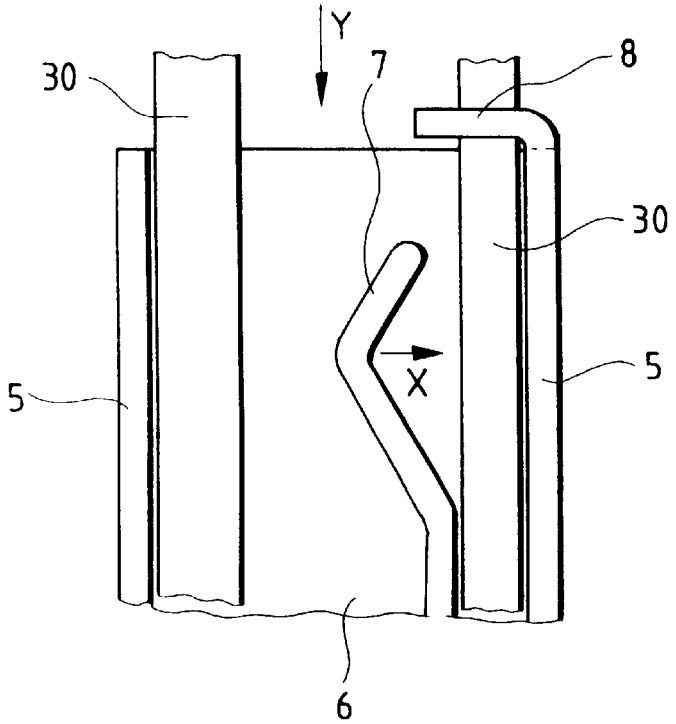
FIG. 2 is a side-elevational view showing an important portion of the connection terminal of FIG. 1.
Figure 3:
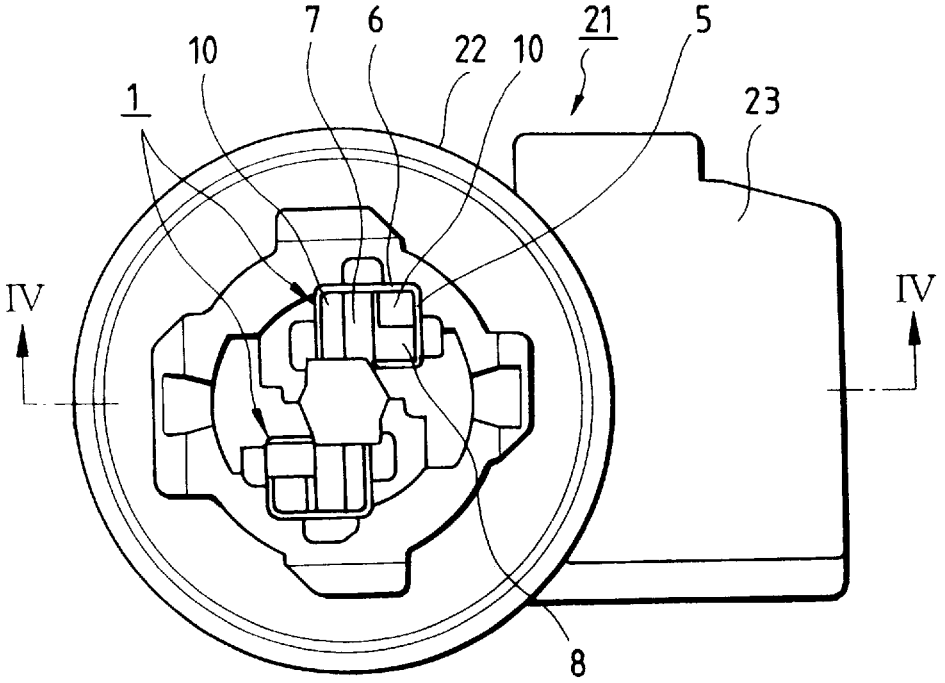
FIG. 3 is a plan view of the bulb socket body having the connection terminals of the present invention insert molded therein.
Figure 4:
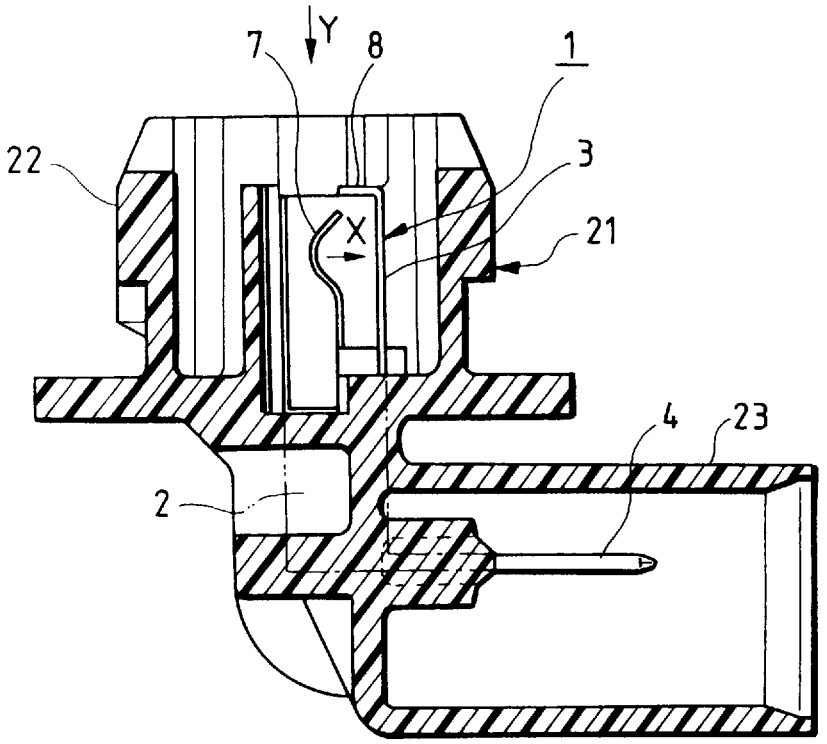
FIG. 4 is a cross-sectional view taken along the line IV—IV of FIG. 3.

As shown in FIGS. 2 and 4, the contact portion 7 is bent relative to the side wall 5, and extends therefrom so that the contact portion 7 has resiliency in a direction X, and this contact portion 7 holds a wedge portion of the bulb inserted in the direction Y, and is electrically connected to the bulb.

Figure 5:
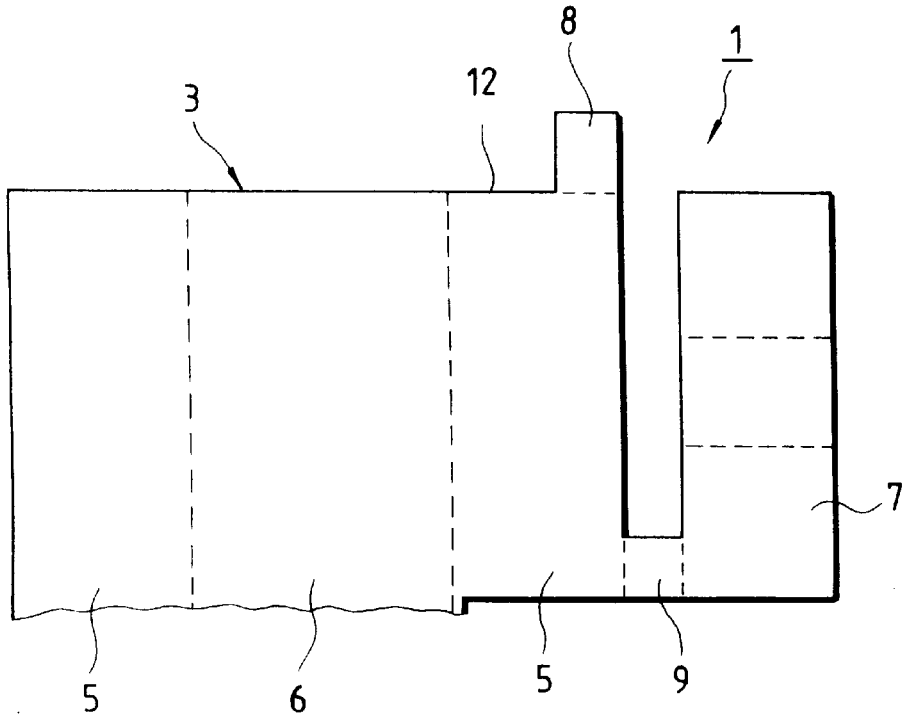
FIG. 5 is a developed view of the connection terminal of FIG. 1.

The connection terminal 1 of this embodiment is first blanked into a shape, shown in FIG. 5, from a metal sheet, and then is bent at those portions thereof indicated by broken lines, so that the connection terminal has a final shape shown in FIGS. 1 and 2. As is clear from FIG. 2, spaces 10 are formed respectively at the inner sides of the two side walls 5 and 5, and the stopper wall 8, formed by bending on the upper edge of the one side wall 5, closes part of the space 10 formed between a back surface of the contact portion 7 and the one side wall 5.

When the bulb socket body 21 is to be molded, with the plurality of connection terminals 1 of the above construction inserted in a mold, tilt prevention inserts 30 and 30 are inserted respectively in the spaces 10 formed respectively at the inner sides of the two side walls 5 and 5, and then a synthetic resin is injected into the mold. With this method, the bulb socket body 21, in which the two side walls 5 and 5 are not deformed inwardly, can be molded.

Figure 8:
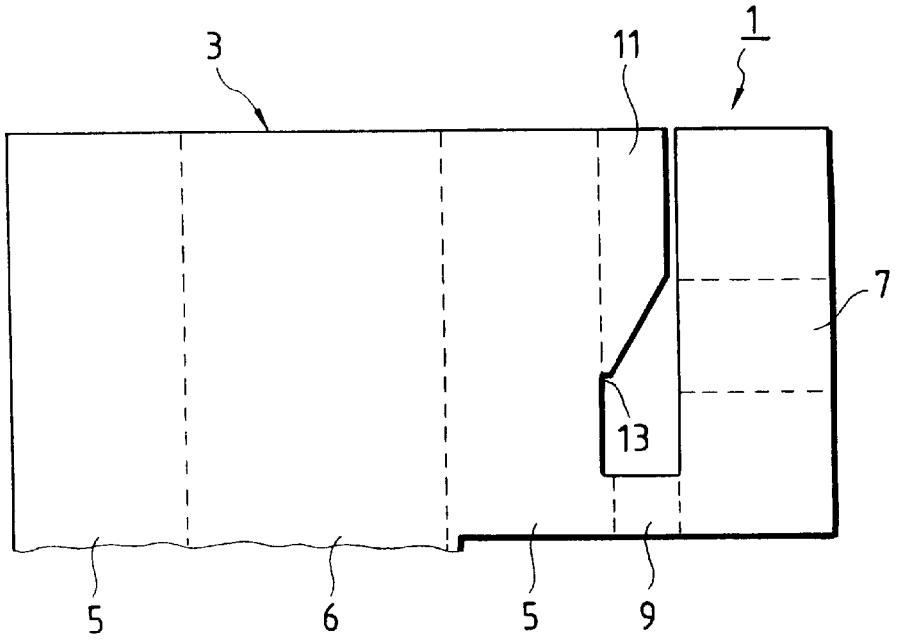
FIG. 8 is a developed view of the connection terminal of FIG. 6.
Figure 6:
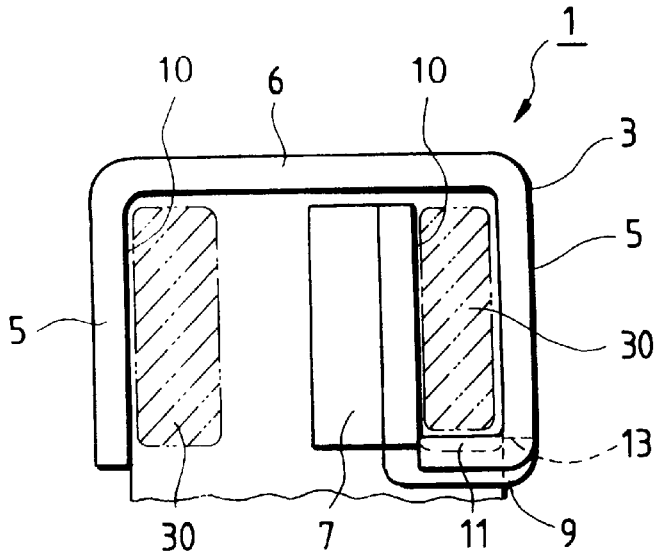
FIG. 6 is a plan view showing an important portion of another embodiment of a connection terminal of the present invention to be insert molded in a bulb socket body.
Figure 7:
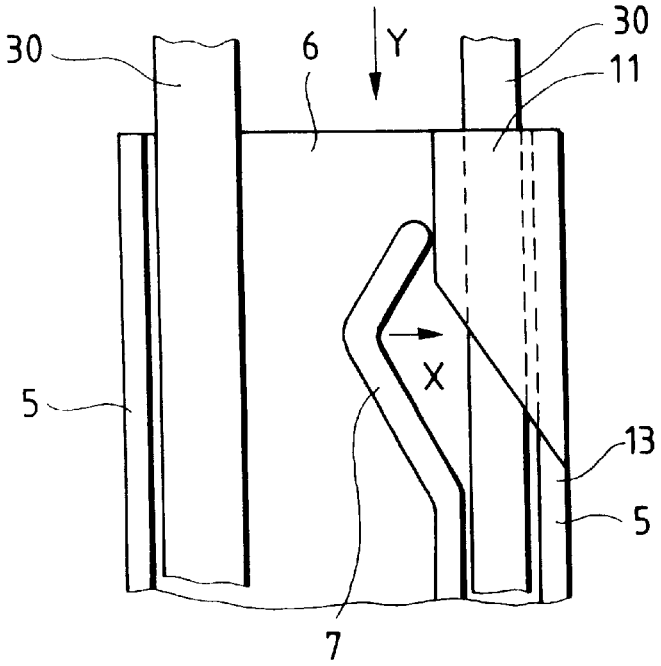
FIG. 7 is a side-elevational view showing an important portion of the connection terminal of FIG. 6.
Figure 9:
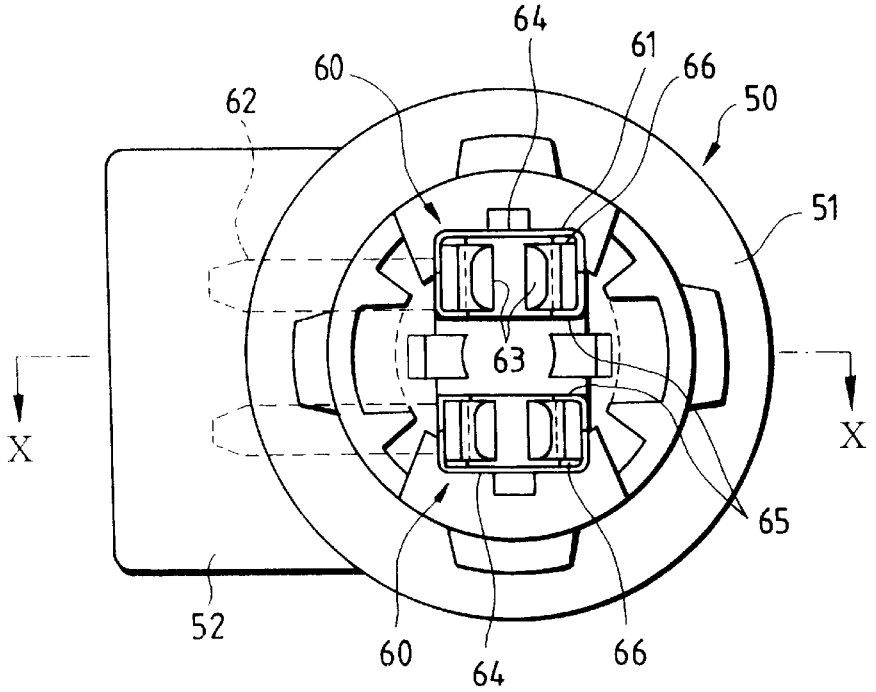
FIG. 9 PRIOR ART
FIG. 9 is a plan view of a conventional bulb socket for a wedge base bulb which socket includes connection terminals.
Figure 10:
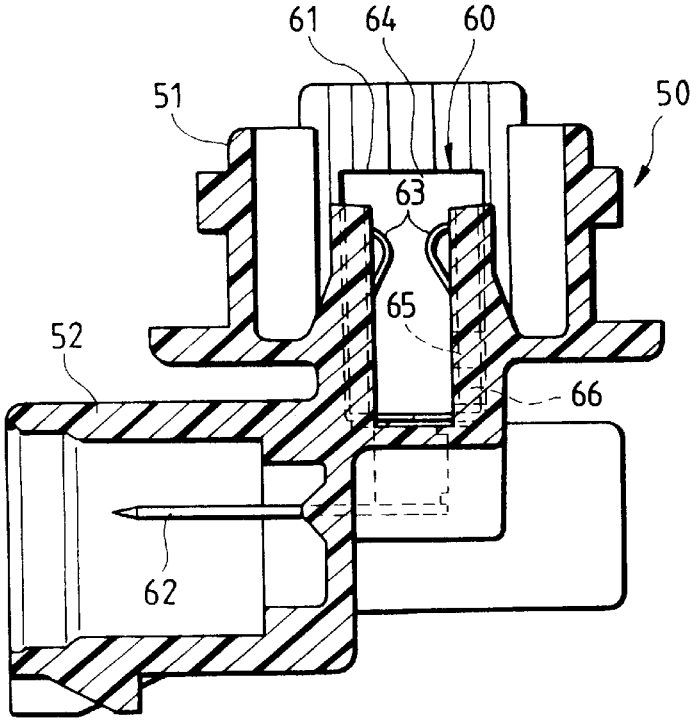
FIG. 10 PRIOR ART
FIG. 10 is a cross-sectional view taken along the line X—X of FIG. 9.
Figure 11:
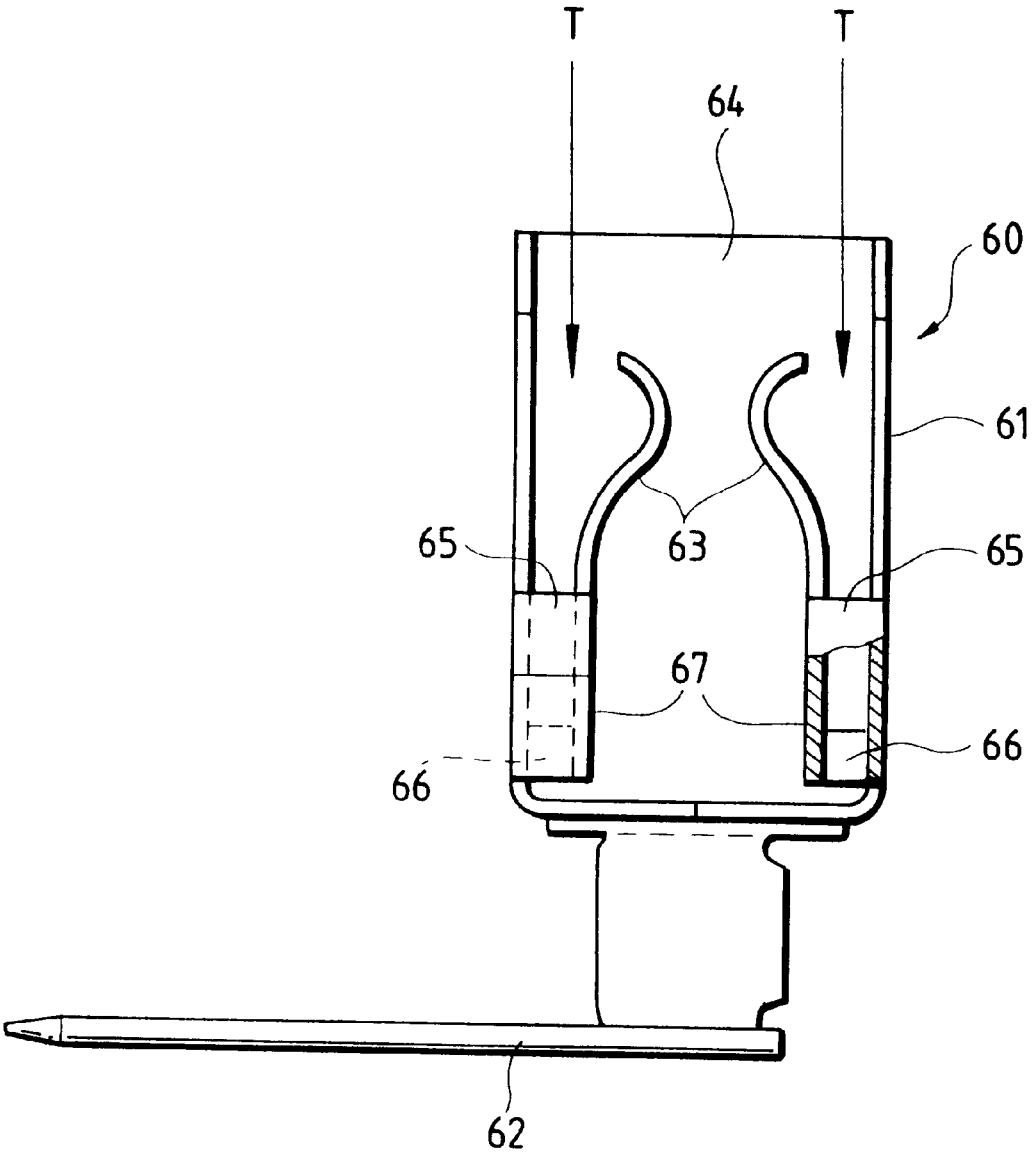
FIG. 11 PRIOR ART
FIG. 11 is a side-elevational view of the connection terminal of FIG. 9.
Figure 12:
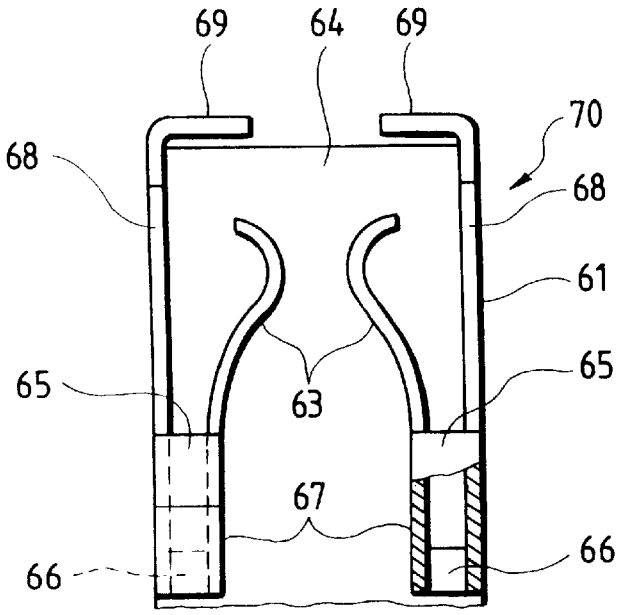
FIG. 12 PRIOR ART
FIG. 12 is a side-elevational view showing an important portion of a conventional connection terminal having bent piece portions.
Figure 13:
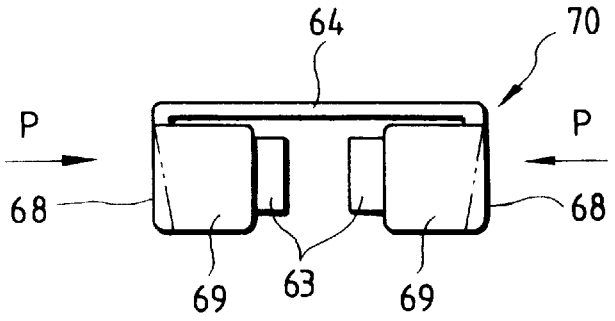
FIG. 13 PRIOR ART
FIG. 13 is a plan view of the connection terminal FIG. 12.

Next, a construction of another embodiment of a connection terminal 1 will be described in detail with reference to FIGS. 6 to 8. FIG. 6 is a plan view of an important portion of the connection terminal to be insert molded in a bulb socket body, FIG. 7 is a side-elevational view showing an important portion of the connection terminal of FIG. 6, and FIG. 8 is a developed view of the connection terminal. Explanation of those portions, identical in shape respectively to those of the above embodiment, will be omitted.

A bulb contact portion 3 includes two side walls 5 and 5 which are bent relative to a proximal end portion, and extend therefrom, a central wall 6 interconnecting the two side walls, a contact portion 7 which is bent relative to one side wall 5 through an extension portion 9 extending from a side edge of the one side wall 5 at a lower end thereof, and a stopper wall 11 which is bent relative to the one side wall 5, and extends from an upper portion of the side edge of the one side wall 5 in a direction perpendicular to a direction Y of insertion of the bulb.

The connection terminal 1 is first blanked into a shape, shown in FIG. 8, from a metal sheet, and then is bent at those portions thereof indicated by broken lines, so that the connection terminal has a final shape shown in FIGS. 6 and 7. As is clear from FIG. 6, spaces 10 are formed respectively at the inner sides of the two side walls 5 and 5, and the stopper wall 11, formed by bending on the side edge of the one side wall 5, closes part of the space 10 formed between a back surface of the contact portion 7 and the one side wall 5.

When the bulb socket body 21 (see FIG. 3) is to be molded, with the plurality of connection terminals 1 of the above construction inserted in a mold, tilt prevention inserts 30 and 30 are inserted respectively in the spaces 10 formed respectively at the inner sides of the two side walls 5 and 5, and then a synthetic resin is injected into the mold. With this method, the bulb socket body 21, in which the two side walls 5 and 5 are not deformed inwardly, can be molded.

As described above, in the connection terminal 1 of the bulb socket plug 21 of the above embodiments, the bulb contact portion 3 has the contact portion 7 for connection to the bulb which contact portion 7 is formed between the two opposed side walls 5 and 5. The stopper wall 8, 11, formed by bending on the side edge of the side wall 5, closes part of the space 10 formed at the back side of the contact portion 7 at the bulb insertion opening. The spaces 10 and 10 for respectively receiving the tilt prevention inserts 30 and 30 for preventing the tilting of the side walls 5 and 5 are formed respectively at the inner sides of the side walls 5 and 5.

Therefore, that surface of the stopper wall 8, 11, facing the bulb, prevents the bulb from being inserted into other portion than the proper insertion portion, and prevents a gouging operation, and therefore the erroneous insertion and gouging insertion of the bulb can be prevented. And besides, since the spaces 10 and 10 are formed respectively at the inner sides of the two side walls 5 and 5, the deformation of the side walls 5 and 5 can be prevented by inserting the tilt prevention inserts 30 respectively into the spaces 10 and 10.

In a method of producing the bulb socket plug of the above embodiments, the bulb contact portion 3 includes the two side walls 5 and 5 opposed to each other through the central wall 6, the contact portion 7 for connection to the bulb which contact portion 7 is bent relative to at least one of the two side walls, and extends therefrom, and the stopper wall 8, 11 which closes part of the space disposed at the back side of the contact portion 7 so as to prevent the erroneous insertion and gouging insertion of the bulb. In this production method, at the time of the molding, the tilt prevention inserts 30 and 30 are inserted respectively into the insert-inserting spaces 10 and 10 formed respectively at the inner sides of the two side walls 5 and 5.

Therefore, by inserting the tilt prevention inserts 30 and 30 respectively into the spaces 10 and 10 formed respectively at the inner sides of the two side walls 5 and 5, the side walls 5 and 5 can be positively prevented from being deformed by the pressure of the injected resin during the molding.

A construction of a further embodiment of a connection terminal (not shown) will be described. A pair of contact portions extend respectively from two side walls of a bulb contact portion, and are bent relative respectively to the two side walls to be opposed to each other. Stopper walls are bent relative to the two side walls, respectively, and extend respectively from suitable portions of the two side walls, and each of these stopper walls closes part of a space formed at a back side of the associated contact portion at a bulb insertion opening side. The stopper walls prevent the erroneous insertion and gouging insertion of the bulb. When the bulb socket plug is to be molded, tilt prevention inserts for preventing the tilting of the side walls are inserted respectively into the spaces formed respectively at the inner sides of the two side walls, thereby preventing the side walls from being deformed by the pressure of the injected resin.

As described above, the bulb socket plug of the present invention comprises the connection terminals each of which includes the bulb contact portion which includes the contact portion for connection to the bulb which contact portion is formed between the two opposed side walls, and the stopper wall which is bent relative to the side wall, and extends from a suitable portion of the side wall, and closes part of the space formed at the back side of the contact portion at the bulb insertion opening side, and the connection terminal further includes the insertion spaces for respectively receiving the inserts for respectively preventing the two side walls from being tilted, and the insertion spaces are formed respectively at the inner sides of the two side walls.

Therefore, the erroneous insertion and gouging insertion of the bulb can be prevented by the stopper wall, and since the spaces are formed respectively at the inner sides of the two side walls, the tilt prevention inserts for preventing the deformation of the side walls can be inserted respectively into these spaces, and therefore the tilting of the side walls can be prevented by inserting the inserts, and therefore the bulb inserting operation can be effected positively and easily, and also the yield rate of the molded products can be enhanced.

In the bulb socket plug, the stopper wall is bent relative to the side wall, and extends from the upper edge or the side edge of the side wall so as to close part of the space disposed at the back side of the contact portion.

Therefore, the erroneous insertion and gouging insertion of the bulb can be positively prevented, and since the insertion spaces for respectively receiving the tilt prevention inserts for preventing the tilting of the side walls are provided, the deformation of the connection terminal during the molding can be positively prevented.

In the method of producing the bulb socket plug of the present invention, the bulb contact portion includes the two side walls opposed to each other through the central wall, the contact portion for connection to the bulb which contact portion is bent relative to at least one of the two side walls, and extends therefrom, and the stopper wall which closes part of the space disposed at the back side of the contact portion so as to prevent the erroneous insertion and gouging insertion of the bulb, and at the time of the molding, the tilt prevention inserts for preventing the tilting of the side walls are inserted respectively into the insert-inserting spaces formed respectively at the inner sides of the two side walls, and in this condition the molding is effected.

Therefore, by inserting the tilt prevention inserts respectively into the spaces, formed respectively at the inner sides of the two side walls, at the time of the molding, the deformation of the side walls by the pressure of the injected resin can be positively prevented, and the yield rate of the molded products can be enhanced.

What is claimed is:

1. A bulb socket plug, comprising:

a body;

a connection terminal being insert molded in the body, the connection terminal including:

a bulb contact portion to which a bulb is detachably connected formed at one end of the connection terminal, the bulb contact portion having first and second side walls opposed to each other and a contact portion formed between the first and second side walls, and a connector contact portion to which a connector is detachably connected formed at the other end of the connection terminal; and a stopper wall extending from the first side wall and being bent, the stopper wall which partially closes a first insertion space formed between the contact portion and the first side wall on a bulb insertion opening side of the bulb contact portion.

2. A bulb socket plug according to claim 1, wherein a second insertion space is formed between the contact portion and the second side wall, and wherein the first insertion space and the second insertion space respectively receive inserts which respectively prevent the first and second side walls from being deformed when the connection terminal is insert molded in the body.

3. A bulb socket plug according to claim 1, wherein the stopper wall extends from an upper edge of the first side wall.

4. A bulb socket plug according to claim 1, wherein the stopper wall extends from a side edge of the first side wall.

5. A method of producing a bulb socket plug, comprising:

a step of preparing a connection terminal which comprises:

a bulb contact portion to which a bulb can be detachably connected formed at one end of the connection terminal, the bulb contact portion having first and second side walls opposed to each other and a contact portion formed between the first and second side walls, a connector contact portion to which a connector can be detachably connected formed at the other end of the connection terminal, and a stopper wall extending from the first side wall and being bent, the stopper wall which partially closes a first insertion space formed between the contact portion and the first side wall on a bulb insertion opening side of the bulb contact portion; and a step of molding the connection terminal, the step of molding which comprises a step of inserting first and second inserts respectively into the first insertion space and a second insertion space formed between the contact portion and the second side wall.

6. A method of producing a bulb socket plug comprising a connection terminal being insert molded therein, the connection terminal including a bulb contact portion to which a bulb is detachably connected formed at one end of the connection terminal, and a connector contact portion to which a connector is detachably connected formed at the other end of the connection terminal, the method comprising:

a step of providing an electrically conductive sheet including a first portion corresponding to the bulb contact portion and a second portion corresponding to the connector contact portion;

a step of blanking the electrically conductive sheet to form at least one planar terminal member;

a step of bending said at least one planar terminal member, the step of bending which comprises a step of forming:

first and second side walls opposed to each other through a central wall, a contact portion extended from at least one of the first and second side walls and bent in between the first and second side walls, and a stopper wall partially closing a first insertion space formed between the contact portion and the first side wall when the bulb contact portion is formed; and a step of molding the connection terminal, the step of molding which comprises a step of inserting first and second inserts respectively into the first insertion space and a second insertion space formed between the contact portion and the second side wall.

* * * * *